US005751668A

United States Patent [19]

Eray

[11] Patent Number: 5,751,668

[45] Date of Patent: May 12, 1998

[54] PUSH BUTTON AND METHOD FOR ASSEMBLING SUCH PUSH BUTTON

[75] Inventor: David Eray, Le Noirmont, Switzerland

[73] Assignee: Eta sa Fabriques d'Ebauches, Grenchen, Switzerland

[21] Appl. No.: 898,524

[22] Filed: Jul. 22, 1997

[30] Foreign Application Priority Data

Jul. 23, 1996 [FR] France ..... 96 09235

[51] Int. Cl.[6] ..... G04B 3/04; G04B 37/10

[52] U.S. Cl. ..... 368/290; 368/319

[58] Field of Search ..... 368/288–290, 368/319–321

[56] References Cited

U.S. PATENT DOCUMENTS

| | | | |
|---|---|---|---|
| 1,096,304 | 5/1914 | Hunter . | |
| 2,391,803 | 12/1945 | Simon | 368/290 |
| 4,118,923 | 10/1978 | Bourquard | 368/319 |
| 5,299,179 | 3/1994 | Miche et al. | 368/290 |

FOREIGN PATENT DOCUMENTS

| | | |
|---|---|---|
| 2245994 | 4/1975 | France . |
| 234157 | 9/1944 | Switzerland . |

*Primary Examiner*—Vit W. Miska

*Attorney, Agent, or Firm*—Sughrue, Mion, Zinn, Macpeak & Seas, PLLC

[57] ABSTRACT

Push button comprising a stem (10), provided with a head (5) able to be manipulated and sliding into an opening (2) provided in the middle part (3) of a timepiece, and stopping means preventing the removal of said stem (10), wherein the stem (10) comprises, on the head side (5), a main cylindrical body (11) extended by a shank (13) separated from the latter by a groove (12) intended to receive an O-ring sealing gasket (30), said shank (13) having at its end an axial stud (17) ending in an annular rim (18), and the stopping means comprise a sleeve (20) inserted between the wall of the opening (2) and the shank (13), partially blocked by a ring (22) of greater external diameter than that of the opening (2) and of substantially equal aperture to the diameter of the stud (17), said (20) sleeve compressing the O-ring sealing gasket (30) and being fixed to the shank (13) by riveting of the annular rim (18).

4 Claims, 1 Drawing Sheet

PUSH BUTTON AND METHOD FOR ASSEMBLING SUCH PUSH BUTTON

The present invention concerns a push button and a method for assembling such push button, which make the manufacturing and fitting of the push button, in particular in a watch case, simpler and more economical and which also render the assembly thereby achieved water-resistant or sealed.

The usual method for assembling a push button, which allows the state of a mechanical or electronic device of a timepiece to be changed via simple pressure, consists in introducing the stem of the push button from the outside of the case, then screwing on the end thereof, from the inside of the case, a stop element allowing extraction of the stem to be prevented and the travel of a return spring to be limited. Generally, the water resistance or sealing between the stem of the push button and the passage through the case is assured by one or more independent sealing gaskets of the push button device itself.

In order to simplify such a construction which requires machining and mounting operations in a relatively small space, various other devices have been proposed.

In CH patent No. 579 031, the stop element is formed by a collar fixed around the stem via setting on the stem. In CH patent No. 599 612, the stop element is integral with the stem, the internal end of which having a slit which provides sufficient resilience to allow snap fitting against the internal face of the case. Other snap fitting methods are also proposed utilising either the resilience of a collar borne by the stem, as disclosed in CH patent No. 610 467, or conversely the resilience of the neck of the hole opening into the case and allowing the passage by force of the stop element as disclosed in CH patent No. 675 811. In every case, the water resistance or sealing between the watch case and the stem of the push button is assured by a sealing gasket which is not directly held or compressed by the stop element and thus requires a particular arrangement of the push button stem or push button head. Moreover, guiding of the stem is not always assured in a satisfactory manner, in particular when the snap fitting technique is used.

An aim of the invention is thus to overcome the drawbacks of previously known push button devices by providing a push button of simple construction which is easy to assemble.

The invention thus concerns a push button for a timepiece comprising a stem, provided with a head able to be manipulated and sliding into a cylindrical opening provided in the middle part of said timepiece, and stopping means preventing the extraction of said stem, characterised in that the stem comprises, on the head side, a main cylindrical body extended by a shank separated from the latter by a groove intended to receive a sealing gasket, said shank having at its end an annular recess forming an axial stud ending in an annular rim, and in that the stopping means comprise a sleeve, inserted between the wall of the opening and the shank, of substantially equal length to the shank, partially blocked by a ring of greater external diameter than that of the opening and of substantially equal aperture to the diameter of the stud, said sleeve compressing the O-ring sealing gasket and being fixed to the shank by riveting of the annular rim of the stem stud against the ring of the sleeve.

The return means of the push button are for example formed by a spring arranged between an annular recess provided in the middle part or the case and the internal portion of the push button head.

The push button head may be a piece added onto the stem, but may also be integral with said stem.

According to the invention, the sleeve held by riveting at the end of the stem thus allows both the accidental pulling out of the push button to be prevented and controlled compression to be exerted on the O-ring sealing gasket in order to assure perfect water resistance or sealing.

According to an alternative embodiment, the control of pressure on the sealing gasket may be adjusted during assembly by providing on the internal surface of the sleeve one or more grooves complementary to annular lips arranged on the shank.

Other features and advantages of the invention will appear more clearly upon reading the following description, which is made with reference to the attached drawings given by way of non limiting examples and in which.

Figure 1:
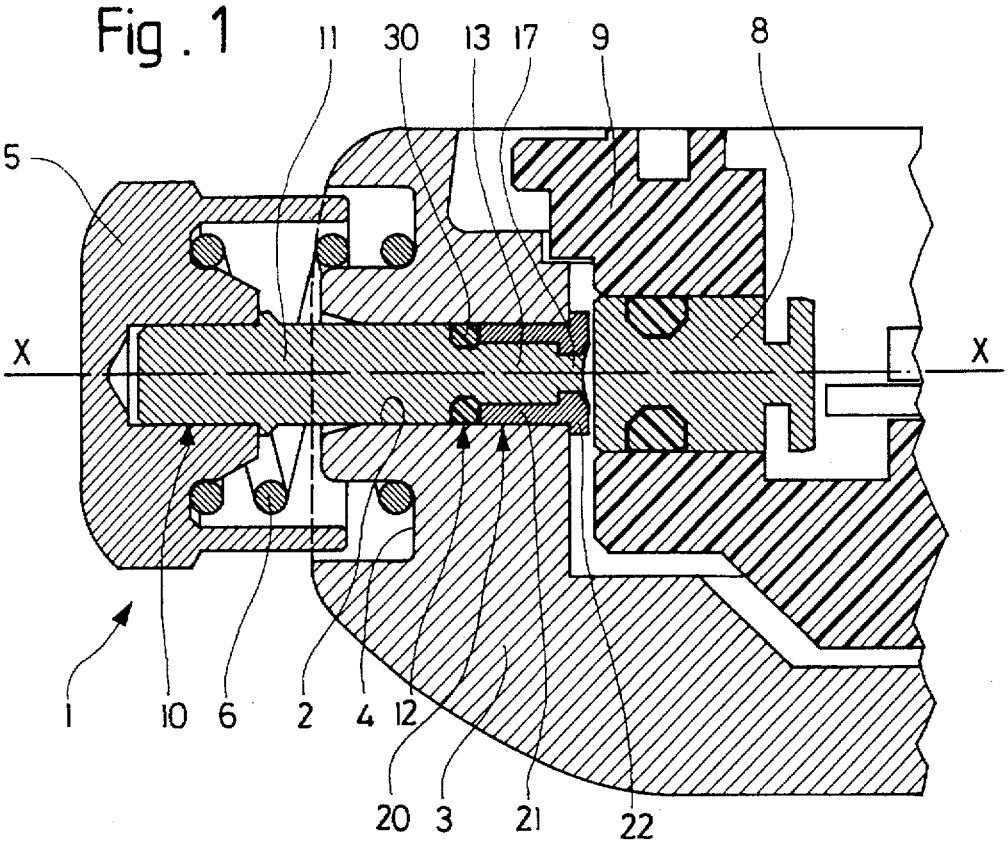
FIG. 1 is a cross-section of a portion of a watch case in which a push button device according to the invention is fitted.
Figure 2:
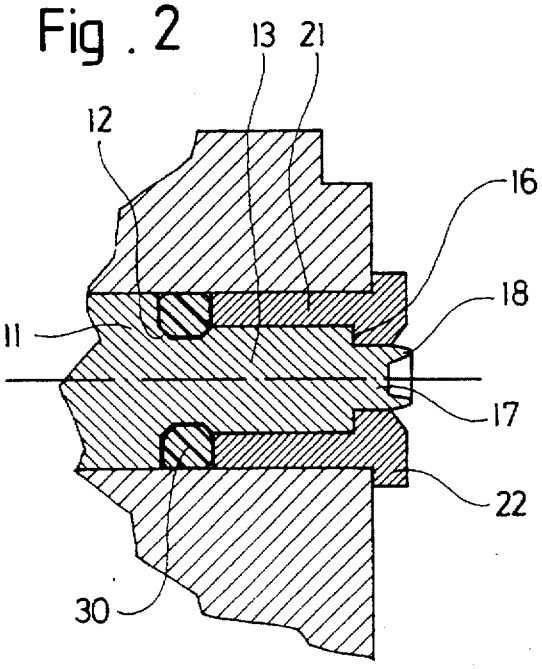
FIG. 2 is an enlarged view of the end of the push button according to FIG. 1.

FIGS. 1 and 2 show a push button 1 mounted in a cylindrical opening 2 of a middle part 3 of a watch case, said push button essentially comprising two parts: a stem 10 rotating about an axis X—X, provided on a portion extending on the outside of middle part 3, with a head 5 able to be manipulated, and a sleeve 20 fixed onto the other end of said stem 10, an O-ring sealing gasket 30 being compressed between the two parts to assure water resistance or sealing between the wall of cylindrical opening 2 and the stem.

Stem 10 comprises a main body 11 of the same diameter as opening 2 and a shank 13 which extends main body 11 and is separated from the latter by a groove 12 wherein an O-ring sealing gasket 30 is partially housed, the distal portion of said shank 13 comprising an annular recess forming an axial stud 17, the end of which has an annular rim 18.

Sleeve 20, made in a single piece comprises a tubular part 21 having a substantially equal thickness to the free space between the internal surface of opening 2 and the external surface of shank 13 and a substantially equal length to that of said shank. Such tubular part 21 is partially blocked at one end by a ring 22 having a thickness substantially equal to the total length of stud 17 and rim 18, a greater external diameter than that of stem passage opening 2, and an opening substantially equal to the diameter of stud 17, said opening being flared outwards in the embodiment shown.

As seen in FIG. 1, when stem 10 and sleeve 20 are assembled, rim 18 is folded back by riveting onto the flared part of ring 22. According to the present invention "riveting" designates any operation allowing rim 18 to be folded back.

The particular method implemented will thus essentially depend on the type of material of which the stem is made. In the most common case of a metal stem, for example stainless steel, rim 18 will simply be hammered or peened. In the case of a material able to be deformed when hot, such as a reinforced thermoplastic material (e.g. with glass or carbon fibre), a heated tool having the same amount of taper as that of the opening of ring 22 will for example be used.

Figure 3:
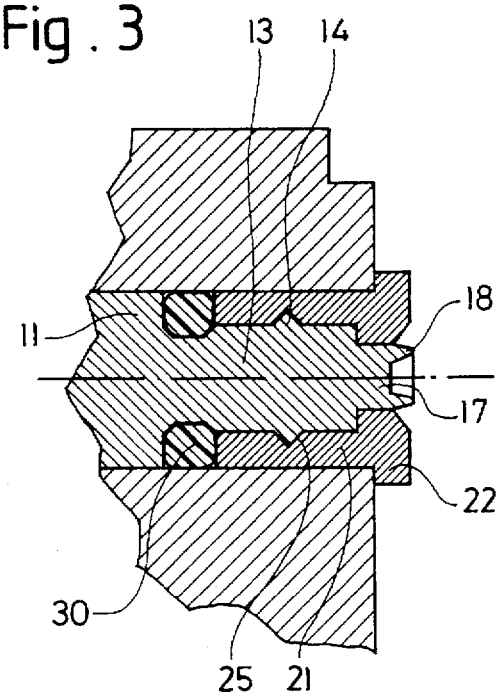
FIG. 3 is an alternative of the embodiment shown in FIG. 2.

Thus, in order to assemble the push button according to the invention, a return spring 6 is first positioned in a groove 4 of the middle part, O-ring sealing gasket 30 is placed in groove 12, stem 10 and head 5 are set in place from the outside of the middle part, pre-assembled if these elements have not been made in a single piece, then sleeve 20 is inserted onto shank 13 from the inside of the case, and next rim 18 is riveted onto the external face of ring 22, which will cause the compression of O-ring sealing gasket 30 by the end of tubular part 21 of said sleeve. As shown by way of example in FIG. 3, the travel of sleeve 20 and its positioning prior to riveting may be adjusted, by providing in the internal surface of sleeve 20 a groove 25 into which a lip 14 provided on shank 13 snap fits.

Returning to FIG. 1, a push button which acts indirectly on an electronic control via an intermediate push button 8 arranged in the housing 9 of the movement is shown. The man skilled in the art may of course envisage other mechanical or electronic control arrangements without departing from the present invention which concerns first the design of a push button and the method for assembling such push button in a watch case.

What is claimed is:

1. A push button for a timepiece comprising a stem, provided with a head able to be manipulated and sliding into a cylindrical opening provided in the middle part of said timepiece, and stopping means preventing the extraction of said stem, wherein the stem comprises, on the head side, a main cylindrical body extended by a shank separated from the latter by a groove intended to receive an O-ring sealing gasket, said shank having at its end an annular recess forming an axial stud ending in an annular rim, and wherein the stopping means comprise a sleeve inserted, between the wall of the opening and the shank, of substantially equal length to the shank, partially blocked by a ring of greater external diameter than that of the opening and of substantially equal aperture to the diameter of the stud, said sleeve compressing the O-ring sealing gasket and being fixed to the shank by riveting of the annular rim against the ring of the sleeve.

2. A push button according to claim 1, wherein the opening of the ring is flared outwards.

3. A push button according to claim 1, wherein the internal surface of the sleeve comprises a groove into which a lip of the shank snap fits to allow positioning of the sleeve prior to riveting.

4. A method for assembling a push button for a timepiece according to claim 1, wherein the stem is set in place from the outside of the case, wherein the sleeve is inserted from the inside onto the shank and wherein the rim is riveted onto the external face of the ring.

* * * * *